United States Patent [19]

Gadsby

[11] Patent Number: 4,953,239

[45] Date of Patent: Sep. 4, 1990

[54] INFLATABLE POOL COVER

[76] Inventor: Harold S. Gadsby, 13069 IH 35 North, San Antonio, Tex. 78233

[21] Appl. No.: 216,151

[22] Filed: Aug. 24, 1988

[51] Int. Cl.[5] ..... E04H 3/19

[52] U.S. Cl. ..... 4/499; 4/504

[58] Field of Search ..... 4/498, 499, 504

[56] References Cited

U.S. PATENT DOCUMENTS

| | | | |
|---|---|---|---|
| 3,128,478 | 4/1964 | Beal | 4/499 X |
| 3,353,309 | 11/1967 | Kwake | 4/499 X |
| 3,676,880 | 7/1972 | Kwake | 4/499 |
| 3,816,859 | 6/1974 | Mosehauer | 4/499 |
| 3,927,427 | 12/1975 | Aine | 4/499 |
| 4,028,750 | 6/1977 | Gustafsson | 4/498 |
| 4,103,369 | 8/1978 | Riordan | 4/499 X |
| 4,122,561 | 10/1978 | Barr | 4/499 |
| 4,192,025 | 3/1980 | Hinsperger | 4/498 |
| 4,606,083 | 8/1986 | Kingston | 4/499 X |

FOREIGN PATENT DOCUMENTS

| | | | |
|---|---|---|---|
| 1582332 | 1/1981 | United Kingdom | 5/455 |

*Primary Examiner*—Charles E. Phillips
*Attorney, Agent, or Firm*—Gunn, Lee & Miller

[57] ABSTRACT

An inflatable swimming pool cover which, when installed and inflated, floats on the swimming pool water's surface and has a bulbous surface rising above the level of the swimming pool's perimeter. A small blower with its exhaust directed into the interior space of the cover initially inflates the cover and thereafter maintains the cover during its use.

1 Claim, 2 Drawing Sheets

INFLATABLE POOL COVER

BACKGROUND OF THE INVENTION

1. Field of the Invention

Applicant's invention is related to apparatuses and methods for covering swimming pools during non-use.

2. Background Information

During the fall and winter seasons, most outdoor swimming pools are not in use and falling leaves and debris driven by winter storms often find their way into such pools. Owners or maintainers of outdoor pools are, therefore, forced to cover their pools or face expensive cleaning operations each Spring.

Presently, pool covers are typically little more than large tarpaulins shaped to overlap the perimeter of a pool. The tarpaulins are held tautly in place by stakes or eye bolts fixed in concrete. A disadvantage attending the use of tarpaulins for covering pools lies in the fact that the same debris which would contaminate the underlying pool if left uncovered accumulates on the tarpaulin surface instead. Any other material falling on the tarpaulins surface, including rain and snow, likewise accumulate on the tarpaulin surface increasing the likelihood that the tarpaulin will be over stressed and torn. Despite the best of efforts, at least a part of the debris collected on the pool cover usually falls into the pool as the cover is removed.

Tarpaulin pool covers also have a much more significantly unfortunate capacity for camouflaging the danger posed to small children by swimming pools, particularly if a substantial amount of debris such as leaves has accumulated on the cover. The flat surface presented by a tarpaulin pool cover often appears to a child to be a surface upon which they may walk. Inability of the tarpaulin and/or its tethering posts to support the weight of a child can have obviously tragic results.

It would, therefore, be advantageous for outdoor pool owners, maintainers, and small children living in the vicinity of a swimming pool to provide an apparatus which covers such pools, resists accumulation of debris, water, and snow on its surface, distinguishes itself from surrounding ground surface by rising above ground level, and costs little more than conventional tarpaulin pool covers.

SUMMARY OF THE INVENTION

It is an object of the present invention to provide an inflatable pool cover.

It is an object of the present invention to provide a pool cover which resists collection of debris thereon.

It is another object of the present invention to provide a pool cover which alerts children to the presence of other than a safe walking surface.

It is another object of the present invention to provide a pool cover which presents a non-planar surface which rises above the level of the pool perimeter but requires no structural support members.

In satisfaction of the above objects, applicant's present invention provides an inflatable pool cover which, when installed and inflated, has a bulbous upper surface. A small blower with its exhaust directed into the interior space of the cover initially inflates the cover and thereafter maintains the cover during its use. Alternatively, the cover could be inflated and maintained by an appropriately arranged vacuum cleaner.

DETAILED DESCRIPTION OF THE PREFERRED EMBODIMENT

Figure 1:
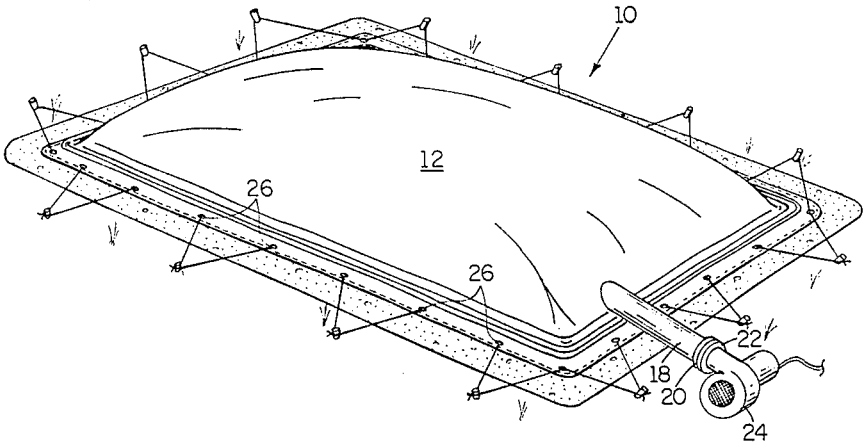
FIG. 1 is a perspective view of the preferred embodiment installed on a typical residential swimming pool

Referring to FIG. 1, applicant's invention provides an inflatable pool cover 10 which, in its preferred embodiment, is shaped so that it covers a swimming pool and the immediately surrounding area when it is inflated and tethered.

Figure 2:
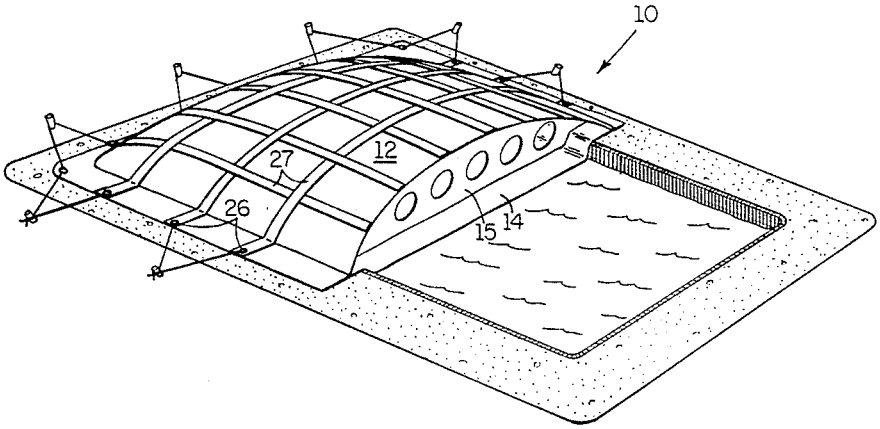
FIG. 2 is a partial cutaway view of the preferred embodiment.

Referring to FIG. 2, the preferred embodiment of applicant's invention is preferably made from two 3–6 mm sheets of polyethylene, an upper layer 12 and a lower layer 14. Polyethylene is chosen because its inexpensiveness and its conduciveness to thermal welding in the assembly process. For discussion herein, it is assumed that the upper and lower layers 12 and 14 are single pieces of polyethylene, but it is to be understood that the layers 12 and 14 may be, and most likely will be composite sheets formed from smaller pieces of polyethylene.

It is anticipated that pool covers 10 made according to applicant's invention will be produced in "off the rack" sizes and shapes for the most common pool configurations, and will also be custom made for non-standard pool sizes and shapes.

In either instance, the upper layer 12 and the lower layer 14 should be cut to approximate the shape of the perimeter of the pool for which the cover 10 is being made, but having a size whereby the layers 12 and 14 would correspond to a magnification of the pool so that, if laid flat over the pool, the layers 12 and 14 would extend outwardly from the pool's perimeter by approximately two feet in all directions.

Referring to FIG. 2, for providing structural integrity of the cover 10 such that the cover 10 does not assume the shape of a cylinder when inflated, shape retaining members 15 are situated within the cover 10. The shape retaining members 15 are sheets of polyethylene cut to approximate the desired cross sectional shape of the cover 10 at approximate 4 foot intervals. The shape retaining members 15 are affixed to the inside of the upper layer 12 and the lower layer 14 by thermal welding Holes are provided in the shape retaining members 15 to allow air within the cover 10 to flow throughout the interior space of the cover to permit uniform inflation of the cover 10.

Figure 3:
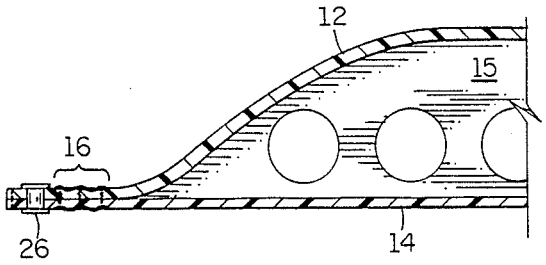
FIG. 3 is a partial cross sectional view of the point of joinder between the upper and lower layers of the preferred embodiment.

Referring to FIGS. 2 and 3, in assembling the cover, the respective perimeters of the upper layer 12 and the lower layer 14 are joined by thermal welding For durability, three parallel welds 16 preferably should be made, the welds 16 being spaced to define a width of at least six inches. The invention will likely be operative if only one weld 16 is made, but as stated, multiples welds are desirable.

For still more durability, the upper and lower layers 12 and 14 should be sewn outside of the outermost thermal weld using commercial sewing machines (stitching visible only in FIG. 1).

For inflating the cover, an air conduit 18 for carrying air from a blower (to be discussed hereinafter) to the inside of the cover 10 is necessary. The conduit 18 may be a tubular segment of vinyl or polyethylene welded over a hole in the upper layer 12 of the cover 10 as shown in the drawings, or may be formed by joining, also by thermal welding, strip-like projections of the upper and lower layers 12 and 14 (not shown in the Figures) to fashion a conduit 18. In the latter instance, the upper layer 12 and the lower layer 14 respectively has an upper air conduit strip and a lower air conduit strip The conduit strips extend radially from corresponding positions on the layers 12 and 14. The conduit strips should be approximately six inches in width and five feet in length. In the manufacturing process, the long sides of the conduit strips will be welded leaving the terminal ends open.

Figure 4:
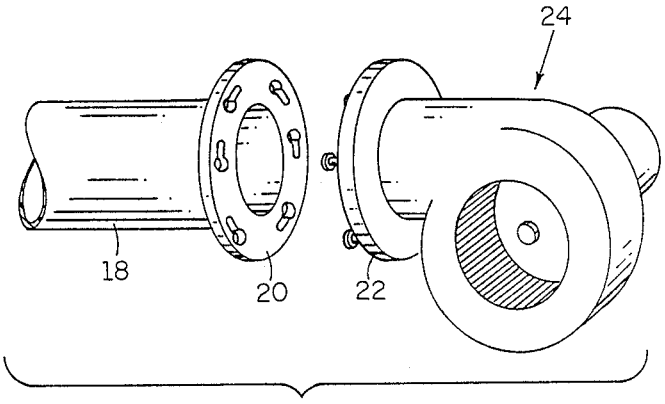
FIG. 4 is an exploded, partial cutaway view of an installed blower mating member and a blower included with the preferred embodiment.

Referring to FIG. 4, a blower mating plate 20 is cemented or otherwise attached to the cover 10 at the opening of the air conduit. The mating plate 20 is designed for joining in a bayonet mount arrangement with the exhaust port 22 of a small squirrel cage blower 24 with an all weather motor certified for outdoor use. The blower's 24 casing will likewise be formed for such joinder with the blower mating plate.

The blower's 24 required minimum motor torque and effluence capacity will vary according to the size of individual pool covers. A blower 24 should be chosen which, not only is capable of inflating the cover, but is also capable of keeping the cover 10 inflated during heavy rain or snow. As a point of reference, it has been determined that a blower 24, capable of maintaining 20 p.s.i. and delivering 15 c.f.m., performs satisfactorily with a cover 10 for a pool whose perimeter delineates a 1000 square foot area Referring in combination to FIGS. 1, 2, and 3, grommets 26 are installed in the perimeter of the cover 10 for tethering the cover 10 during use. The grommets 26 should be positioned relative to the edge of the cover 10 such that they are situated between the two outermost welds 16. Such placement insures that no air leaks are formed in the cover 10 and that the grommets 26 are not so close to the cover's 10 edge that they are easily ripped out by force from wind blowing on the cover 10.

Referring again to FIG. 2, an alternative embodiment of applicant's invention may include a safety matrix (indicated only in FIG. 2) formed from lengths of synthetic webbing 27 much like that used for lawn chairs. The safety matrix is for providing a "net" for catching and supporting any individual who may walk onto the cover 10. At a minimum, the webbing 27 is attached to the cover 10 at the grommets 26. Therefore, the webbing will be as stably supported as can be by the chosen tethering means. The lengths of webbing 27 are placed in a woven arrangement and are stitched one to the other at their respective points of intersection. The webbing lengths 27 may be further attached to the cover 10 and concealed for aesthetic purposes by including overlying strips of polyethylene (not shown in the drawings) which strips are thermally welded to the upper layer 12 on either side of the webbing lengths 27.

When a cover 10 of applicant's invention is to be installed, the lower layer 14 is stretched over the pool surface to evenly and flatly overlie the pool. If not previously installed, tethering posts or satisfactorily anchored eye bolts should be installed corresponding in number and placement to the grommets of the cover. The cover 10 should be attached, via the grommets, to the tethering sites using rope or a suitable substitute. Once the cover 10 is in place, the blower 24 should be attached to the air conduit 18 at the blower mating plate 20 and the blower 24 should be turned on.

For ease of installation, the cover 10 should be installed on a calm, dry day. Wind would tend to complicate handling the cover, and wet ground would increase the danger of handing the electrical cord of the blower.

Over a period of several hours, the cover 10 will inflate and will remain inflated so long as the blower 24 remains on. The upper layer 12 will rise under the interior air pressure between the upper and lower layers and assume a bulbous shape, while the lower layer 14 simply floats on the water within the pool.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention.

It is, therefore, contemplated that the appended claims will cover 10 such modifications that fall within the scope of the invention.

I claim:

1. An inflatable swimming pool cover comprising:

an upper layer having a first perimeter and a lower layer having a second perimeter, said upper and lower layers being made of a material substantially impermeable to air and water, said lower layer having dimensions whereby said lower layer, if laid on the surface of the pool water at a normal level would form a flat shape over said pool water whereon said cover is to be installed, and said record perimeter would extend outwardly beyond said swimming pool's outer boundary, said upper layer having dimensions whereby said upper layer, if inflated, in combination with said lower layer over a swimming pool water surface whereon said cover is to be installed would form a dome shape with relatively steep sides that direct rain water, leaves and other debris off of said cover entirely and over the edge of the pool boundary, said first perimeter would extend outwardly beyond said swimming pool's outer boundary and said first and second perimeters would be coincident;

said upper layer having a hole formed therethrough, said hole being small relative to the size of said upper layer;

said first and second perimeters are sealingly attached one to the other whereby a substantially air-tight interior space is defined between said upper layer forming said dome shape and said lower layer forming said flat shape except as prevented by said hole;

said cover having an air conduit sealingly attached to said upper layer over said hole whereby said air conduit provides the sole avenue of fluid communication between said interior space and space exterior to said cover through an air conduit opening at the terminal end of said air conduit;

blower means for providing a continuous effluence of air for inflating and maintaining the inflation of said interior space with said air, said blower means having an output orifice wherefrom said air exits said blower means;

a blower mating member for lockingly mating with said output orifice of said blower means for receiving substantially all of said blower means' continuous effluence of air, said blower mating member being sized whereby said blower mating member tightly fits within said air conduit at said air conduit opening, said blower mating member being sealingly joined with said air conduit with adhesive means;

a plurality of lengths of synthetic webbing, each of said lengths extending across said upper layer forming said dome shape beginning at a first respective said grommet on a first side or end of said cover and terminating at a second respective said grommet on a second side or end of said cover, said lengths being attached to said upper layer by said respective grommets' passing through said lengths prior to passing through said upper and lower layers, said plurality of lengths being placed in a woven arrangement overlying said upper layer forming said dome shape and being sewn together at said lengths respective intersections, said plurality of lengths providing a safety net for supporting individuals who come to rest on said cover when installed on said pool; and one or more retaining members situated between and attached to said upper and lower layers, wherein said retaining members are sheets of material cut to approximate the desired cross sectional shape of said cover when inflated, each said retaining member being formed whereby air may move therethrough throughout the interior space of said cover to permit uniform inflation thereof.

* * * * *